US008839971B2

(12) United States Patent
Aneas

(10) Patent No.: US 8,839,971 B2
(45) Date of Patent: Sep. 23, 2014

(54) DEVICE FOR STOPPING A CONTAINER, CONTAINER EQUIPPED WITH SUCH A DEVICE AND METHOD FOR CLOSING A BATCH OF SUCH CONTAINERS

(75) Inventor: Antoine Aneas, Menetrol (FR)

(73) Assignee: West Pharmaceutical Services Deutschland GmbH & Co. KG, Eschweiler (DE)

( * ) Notice: Subject to any disclaimer, the term of this patent is extended or adjusted under 35 U.S.C. 154(b) by 1433 days.

(21) Appl. No.: 12/449,302

(22) PCT Filed: Feb. 8, 2008

(86) PCT No.: PCT/FR2008/000154

§ 371 (c)(1),
(2), (4) Date: Oct. 22, 2009

(87) PCT Pub. No.: WO2008/129144

PCT Pub. Date: Oct. 30, 2008

(65) Prior Publication Data

US 2010/0050575 A1 Mar. 4, 2010

(30) Foreign Application Priority Data

Feb. 9, 2007 (FR) ..... 07 00939

(51) Int. Cl.

| | |
|---|---|
| ***B65D 39/00*** | (2006.01) |
| ***B65D 45/32*** | (2006.01) |
| ***B65D 51/24*** | (2006.01) |
| ***B65D 41/28*** | (2006.01) |
| ***B65D 51/00*** | (2006.01) |

(52) U.S. Cl.

CPC ..... *B65D 41/28* (2013.01); *B65D 45/322* (2013.01); *B65D 51/241* (2013.01); *B65D 51/002* (2013.01)

USPC ..... 215/247; 215/40; 215/249; 215/251; 215/258; 215/263; 215/274; 215/307; 215/321; 215/350; 220/259.3; 220/259.5; 220/315; 220/319; 220/800; 220/801

(58) Field of Classification Search

USPC ..... 215/40, 247, 249, 251, 258, 263, 274, 215/307, 321, 350; 220/259.3, 259.5, 315, 220/319, 800, 801

See application file for complete search history.

(56) References Cited

U.S. PATENT DOCUMENTS

| | | | | |
|---|---|---|---|---|
| 3,926,341 | A * | 12/1975 | Lhoest | 222/95 |
| 5,314,084 | A | 5/1994 | Folta et al. | |
| 5,555,988 | A * | 9/1996 | Koch et al. | 215/249 |

FOREIGN PATENT DOCUMENTS

| | | |
|---|---|---|
| WO | WO 2005/000703 | 1/2005 |

*Primary Examiner* — Fenn Mathew
*Assistant Examiner* — Elizabeth Volz
(74) *Attorney, Agent, or Firm* — Panitch Schwarze Belisario & Nadel LLP

(57) ABSTRACT

This device comprises an elastomer stopper (501) and a cap (502) suitable for covering both the neck (12) of a container and the stopper in position in this neck. The cap comprises a ring (503) provided with means (503G) for locking it to the neck and an operating member (504). The operating member (504) is fitted with at least one deformable part (506C) for transmitting a thrust load ($f_2$) parallel to a central axis ($X_{503}$) of the ring (503), between two portions (505, 506) of this member (504) or between an external material (301) and this member (504). The load transmitting part (506C) is deformable between a first configuration in which its length ($L_{506}$) parallel to the central axis ($X_{503}$) is a first value and a second configuration in which this parallel length is a second value that is less than the first value.

16 Claims, 10 Drawing Sheets

DEVICE FOR STOPPING A CONTAINER, CONTAINER EQUIPPED WITH SUCH A DEVICE AND METHOD FOR CLOSING A BATCH OF SUCH CONTAINERS

The invention deals with a device for stopping a container provided with a neck, and a container equipped with such a device. The invention also deals with a batch of such containers and with a method for closing such a batch.

In the field of containers for medicines, it is known to use a glass bottle to retain an active principle in freeze-dried, powder or liquid solution form. Such a bottle must be sealed in a leakproof manner in order to maintain its content in a satisfactory state of conservation, until its usage date. To hermetically close a bottle, it is known to use a stopping device which comprises an elastomer stopper, the function of which is to ensure a totally gas-, liquid- and bacteria-tight seal. This device also comprises a capsule which, as mentioned in U.S. Pat. No. 5,314,084, can be made of plastic and is intended to be immobilized around the stopper to insulate it from the outside.

When the content of a container is freeze-dried, a drying procedure is applied to remove the water from the product by sublimation.

When a part of a cap has to be displaced to be locked around the neck of a container, friction occurs, the intensity of which varies according to the manufacturing tolerances of the constituent parts of the cap and the prepositioning of these parts when they are installed on the neck of the container. Thus, when a pressure plate is used to lock the caps of a large number of containers, given the manufacturing tolerances of the constituent parts of these caps and the operating plays of the pressure plate, some caps may not be locked correctly. Similarly, the dimensional variations of the containers themselves and of the stoppers used have a negative influence on the closure of a batch of containers. Given these difficulties, until now it has not been the practice to seal containers in batches inside a freeze-dryer, which imposes complex and therefore costly handling procedures when packaging freeze-dried products.

It is these drawbacks that the invention more particularly seeks to remedy by proposing a stopping device thanks to which a locking force for a bottle top can be effectively transmitted, including taking into account the manufacturing tolerances of the bottles, of the stoppers, of the constituent parts of a bottle top, and of the mechanical members for applying a force.

To this end, the invention relates to a device for stopping a container provided with a neck, this device comprising an elastomer stopper and a cap made of plastic, able to cover both the neck and the stopper in position in the neck, the cap comprising a ring, able to surround the stopper and the neck in the fitted configuration and provided with means for locking it onto the neck, and an operating member able to be fitted on the ring and provided with first means of transmitting a thrust force to the ring and second means of activating the ring locking means. This device is characterized in that the operating member is equipped with at least one deformable element for transmitting a thrust force, parallel to a central axis of the ring, between two parts of said member or between an external appliance and this member, and in that the force transmission element is deformable between a first configuration in which its length parallel to the central axis has a first value and a second configuration in which its length parallel to this axis has a second value less than the first value. Thanks to the invention, the thrust force exerted, for example, by a pressure plate is transmitted by the force transmission element or elements so as to allow for the bottle top to be effectively locked around the stopper, it being understood that, when this force has been effectively transmitted, the force transmission element can be deformed, from its first to its second configuration, so that it does not hamper the transmission of the force in stopping devices fitted on neighboring containers. Thus, it is possible to close containers belonging to a batch of containers thanks to a common force applied by means of a single pressure plate, even when there are dimensional variations between these containers, their stoppers and the associated caps, and even when the pressure plate may not be strictly flat.

According to advantageous but non-mandatory aspects of the invention, such a device can incorporate one or more of the following characteristics:

- The force transmission element is able to be deformed by buckling to change from its first to its second configuration.
- The force transmission element comprises a straight tongue extending in a direction parallel to that of the thrust force and one end of which is joined to a part of the operating member, whereas its other end is free and forms a transmission surface for the thrust force.
- The tongue has an overall parallelepipedal and constant section along its length, the tongue having, in its first configuration, a length with a value greater than or equal to six times its thickness.
- The operating member comprises an annular key which bears the first and second means, and a cover fitted on the key, whilst the force transmission element or elements is or are positioned between the cover and the key and is or are able to transmit the thrust force from the cover to the key.
- The force transmission element or elements is or are positioned on a face of the cover facing toward the key and able to bear against the key to transmit the thrust force to it, whilst the cover is flexible, so as to accompany the deformation of the force transmission element or elements when it or they change from its or their first configuration to its or their second configuration.
- The cover is provided with a deformable annular zone situated radially, relative to a central axis of the cover, inside a circumference at the level of which are arranged the force transmission elements.
- The cover is provided, on its face opposite to that bearing the force transmission element or elements, with at least one relief positioned so that a part of the cover surrounding the deformable zone has a surface that is not totally flat. In this case, the relief is advantageously a groove that links the deformable zone of the cover to the external peripheral edge of the latter.
- The force transmission element or elements is or are positioned on a face of the key facing toward the cover and this element or these elements is or are able to receive the cover bearing on it or them.
- The deformable thrust force transmission element or elements is or are positioned on a face of the cap opposite to the stopper.
- The activation means comprise an annular edge of the operating member, said edge being able to be engaged between an external skirt of the ring and at least one tab forming a locking means and extending radially toward a central axis of the ring from its skirt.

The invention also relates to a container equipped with a stopping device as described above. A container of this type is easier to stop than those of the prior art.

In a batch of containers of this type, provision is advantageously made for, after the force transmission elements have changed to their second configuration and the thrust force has been eliminated, the caps to be able, through elasticity, to assume one and the same configuration, which facilitates the subsequent inspection operations.

The invention finally relates to a method for closing a batch of containers as mentioned hereinabove, this method comprising steps consisting in:

a)—exerting, on the stopping devices of a plurality of containers and by means of a pressure plate, a thrust force directed toward the containers and b)—maintaining the thrust forces until the force transmission elements of the various stopping devices all change from their first to their second configuration.

Advantageously, in the step b), the value of the thrust force is gradually increased.

The invention will be better understood and other benefits of it will become more clearly apparent in light of the description below, given with reference to the appended drawings in which:

FIGS. 1 to 5 diagrammatically represent, in axial cross section and in perspective, a number of steps for packaging a product in bottles according to the invention;

FIGS. 6 and 7 diagrammatically represent, in perspective, two steps of use of a bottle formed in accordance with the approach represented in FIGS. 1 to 5;

Figure 1:
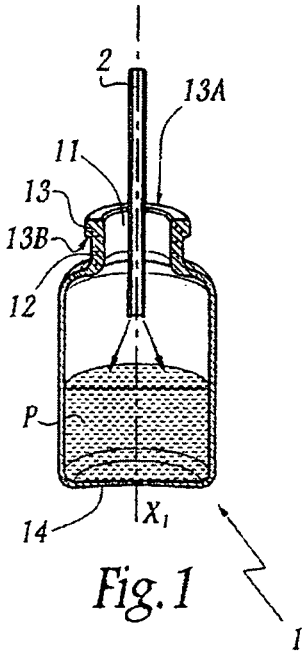
FIGS. 1 to 5 represent different steps in packaging a product P in bottles. For clarity in the drawing, only one bottle is represented in FIGS. 1, 2 and 5, whereas a plurality of bottles are represented in FIGS. 3 and 4.
Figure 2:
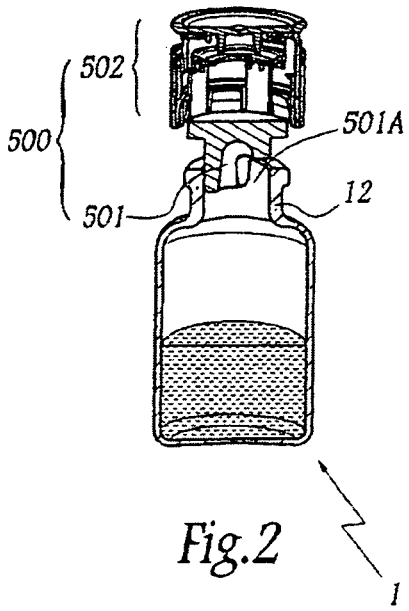

In FIG. 1, a glass bottle 1 is being filled with a product P, for example with a medicine. A pipette 2 is inserted into the bottle 1 through its throat 11 which is defined by a neck 12 having an external collar 13. $X_1$ denotes the axis of symmetry of the bottle 1.

When a predetermined quantity of product P has been introduced into the bottle 1, the pipette is removed and a stopping device 500 is fitted on the neck 12. The device 500 comprises an elastomer stopper 501 of a shape suitable to be partially introduced into the throat 11, while resting on the face 13A of the collar 13 opposite to the bottom 14 of the bottle 1. In position in the neck 12, the stopper 501 insulates the content of the bottle 1 from the outside. The device 500 also comprises a cap 502 designed to cover and insulate the stopper and the neck 12 in the closed configuration of the stopping device.

Figure 9:
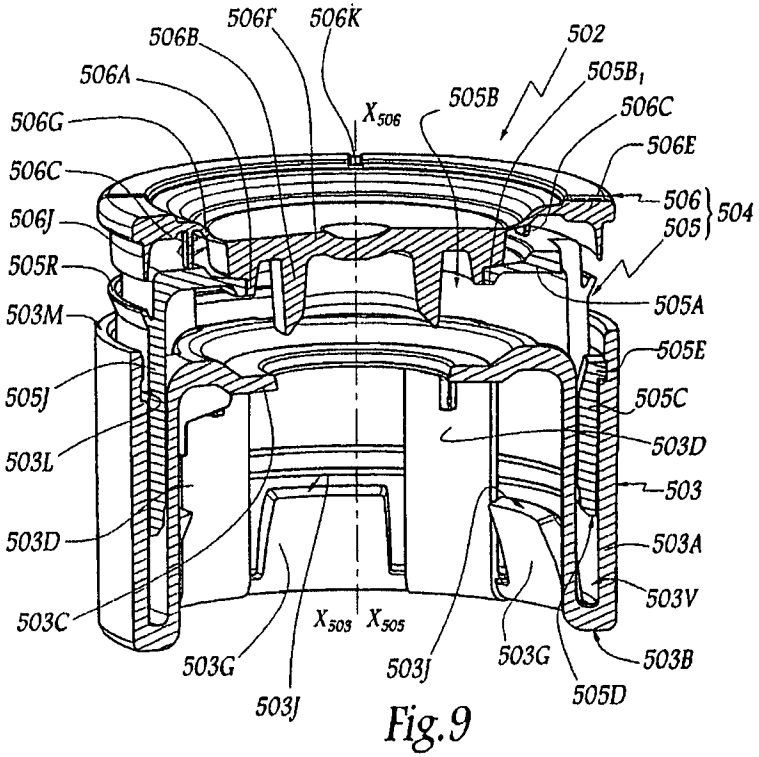
FIG. 9 is an axial cross section, in perspective and on a larger scale, of the cap of the bottle stopping device of FIGS. 1 to 8.

As emerges more particularly from FIG. 9, the cap 502 comprises a ring 503 made of plastic, the internal diameter of which is sufficient to enable it to surround the collar 13.

The cap 502 also comprises an operating member 504 consisting of an annular part 505 made of plastic, that is referred to as a "key" hereinafter, and a cover 506, also made of plastic, attached reversibly to the key 505. The key 505 has an annular part 505A in the center of which is defined an opening 505B and which is extended by a skirt 505J. The portions 505A and 505J are centered on an axis $X_{505}$ which is a central axis of the key 505.

The cover 506 bears a first lip 506A designed to be fixed on the edge 505$B_1$ of the opening 505B and centered on a central axis $X_{506}$ of the stopper 506.

The cover 506 is also provided with a second annular lip 506B which is engaged in the opening 505B, to bear against the top surface of the stopper 501, when the elements 505 and 506 are joined to form the member 504.

The key 505 is provided with a set of three elastic tongues 505C provided by the creation of three openings 505Q in the skirt 505J. 505D denotes the annular edge of the skirt 505J which is opposite to the part 505A.

Each tongue 505C is provided with an external rib or nose 505E which projects radially relative to the skirt 505J. Thus, each tongue 505C forms an elastic hook.

The distance, taken parallel to the axis $X_{505}$, between the ribs 505E and the edge 505D, is denoted $d_1$.

Moreover, the key 505 is provided with a peripheral collar 505R which projects radially relative to the skirt 505J and which extends continuously between two openings 505Q. The distance taken parallel to the axis $X_{505}$, between the free edge 505$R_1$ of the collar 505 and the edge 505D, is denoted $d_2$. The value $d_2$ is greater than the value $d_1$.

The collar has an overall tapered form about the axis $X_{505}$ and divergent moving away from the edge 505D.

Figure 10A:
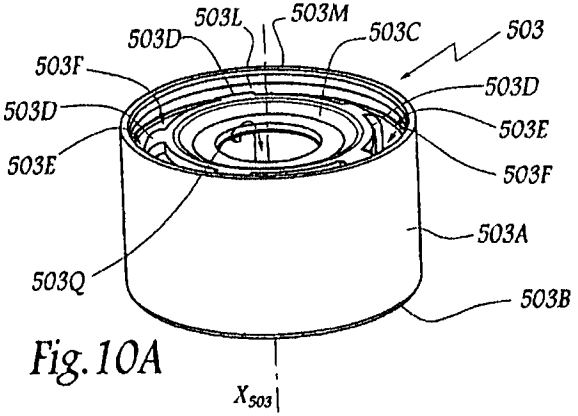
FIGS. 10A and 10B are perspective views, from two different angles, of a ring belonging to the cap of FIG. 9.
Figure 10B:
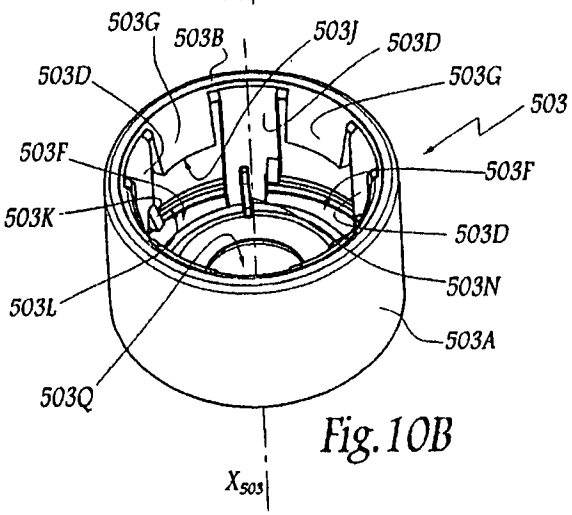

As for the ring 503, it includes a peripheral annular skirt 503A, a first edge of which is denoted 503B. Inside the skirt 503A and opposite the edge 503B, an annular part 503C is provided that is overall perpendicular to a central axis $X_{503}$ of the ring 503 and of the skirt 503A. The part 503C is extended, at the level of five angular segments distributed around the axis $X_{503}$, by five connecting straps 503D which are connected to the internal surface of the skirt 503A in the vicinity of the edge 503B. The connecting straps 503D extend away from the internal surface of the skirt 503A, so that they define five individual elongate recesses 503E into which the skirt 505J of the key 505 can be inserted via the side of the ring 503 that bears the part 503C and that is visible in FIG. 10A.

In the angular segments where the part 503C is not prolonged by connecting straps 503D, five openings 503F are provided in each of which the skirt 505J can also be introduced when said skirt is introduced into the recesses 503E.

Facing each opening 503F, a locking tab or tongue 503G is provided which extends, from the internal face of the skirt 503A, radially toward the axis $X_{503}$. The free edge of each tab 503G is denoted 503J. The ends of the connecting straps 503D and of the tabs 503G are positioned alternately, inside the skirt 503A and in the vicinity of the edge 503B.

The device 500 is assembled by fitting the cover 106 on the key 105, then by aligning the axes $X_{505}$ and $X_{506}$, already combined, with the axis $X_{503}$ and by engaging the skirt 505J in an annular volume 503V defined between the skirt 503A, the connecting straps 503D and the locking tabs 503G. Given the annular nature of the edge 505D and of the volume 503V, the member 504 can be fitted on the ring 503 with no particular precautions as to its angular orientation about the axis $X_{503}$. This facilitates the fitting of the cap 502 because this orientation does not need to be checked.

The internal face of the skirt 503A is provided with a peripheral groove 503L provided in the vicinity of the edge 503M of the skirt 503A opposite the edge 503B and adjacent to the part 503C. The groove 503L is configured to receive the ribs 503E of the tongues 505C when the member 504 is fitted on the ring 503. More specifically, when fitting the member 504 on the ring 503, the skirt 505J penetrates into the volume 503V through the openings 503F and the entry openings of the recesses 503E. The skirt 505 then advances toward the edge 503B until the ribs 505E of the tongues 505C are engaged in the groove 503L, which makes it possible to keep the member 504 at a distance from the part 503C, in the position represented in FIG. 9.

It is then possible to partially introduce the stopper 501 to the neck 12, then to place the cap 502 on this stopper. In this configuration, the stopper 501 does not completely block the throat 11 since this stopper is provided with a lateral cut 501A providing an interstice 200 level with a part of the top face 13A of the throat 13.

Figure 3:
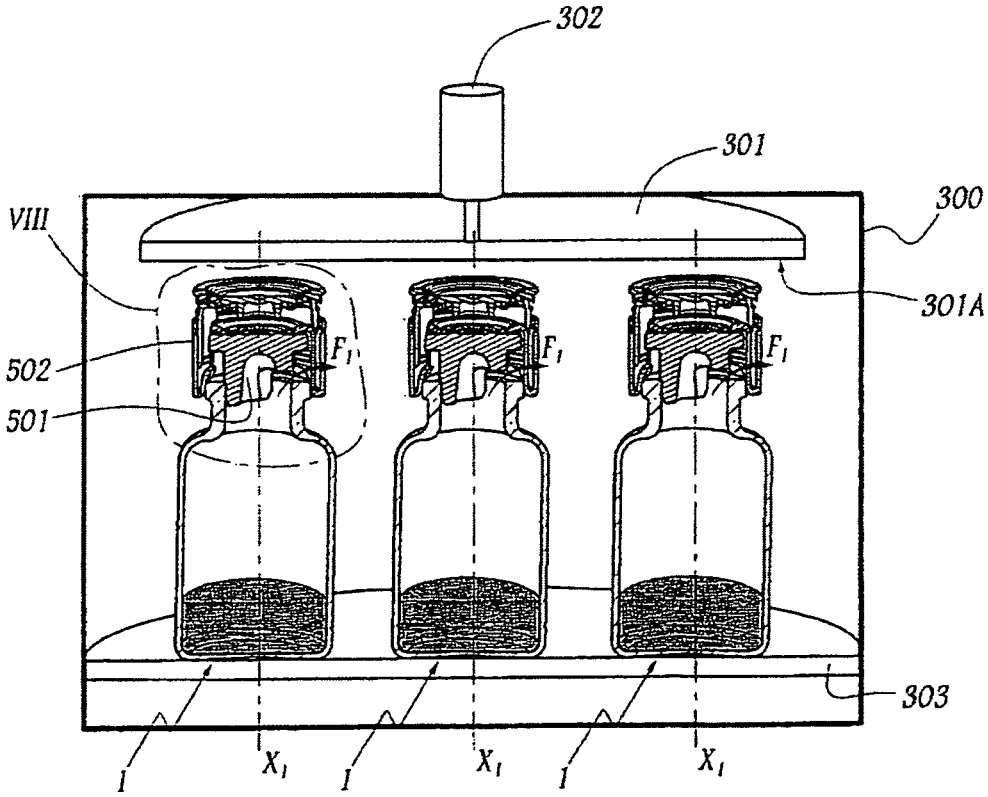
Figure 4:
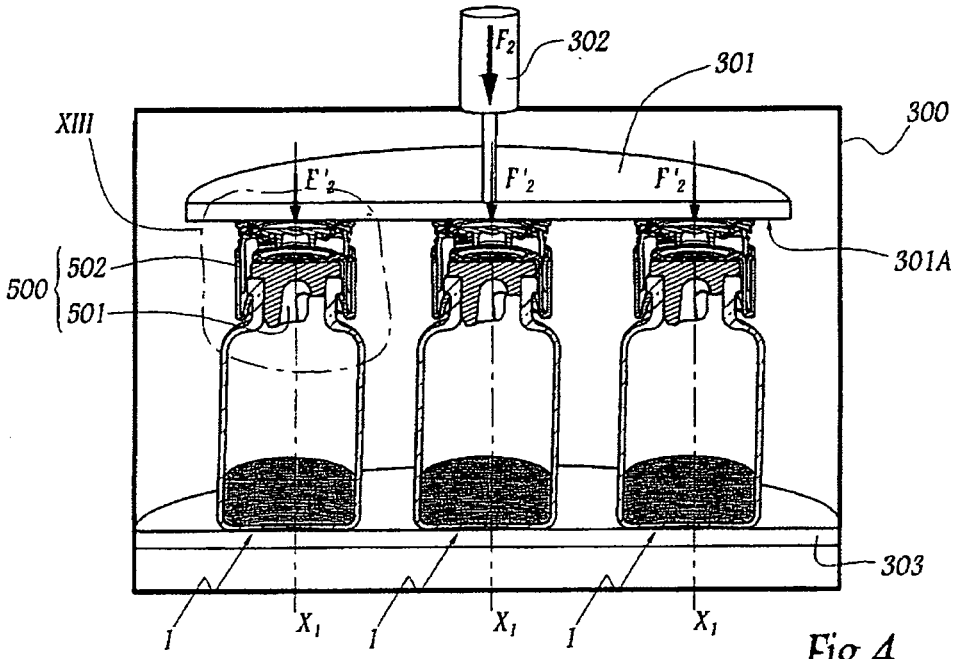
Figure 5:
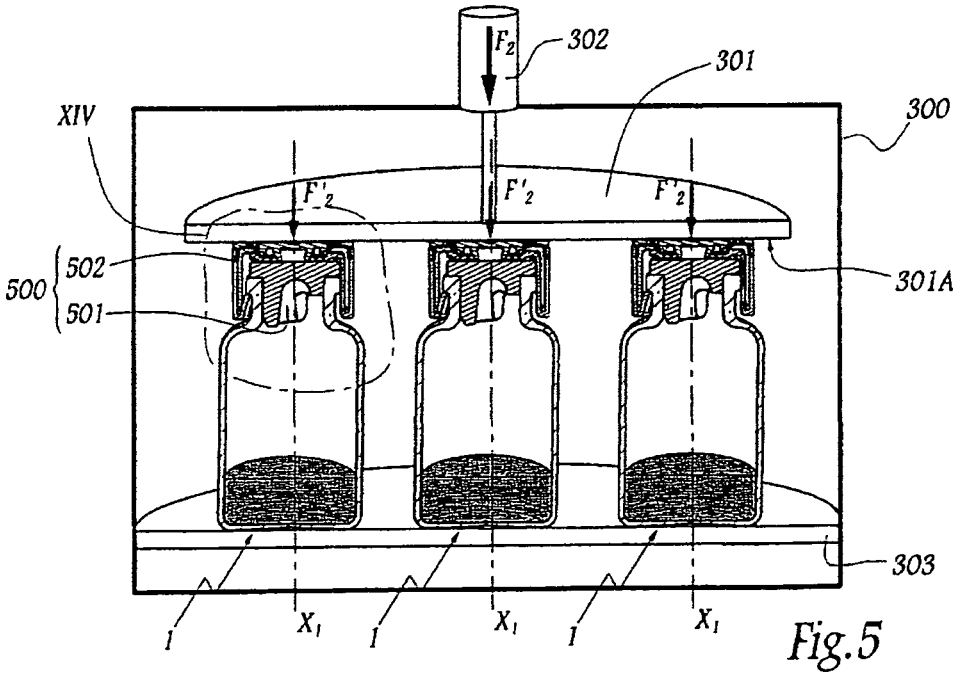
Figure 19:
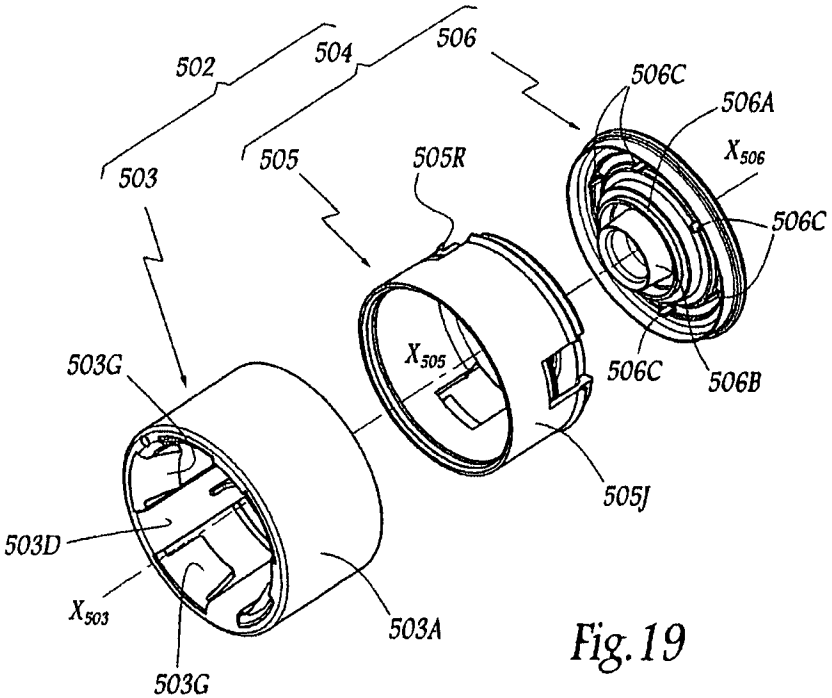
FIG. 19 is an exploded perspective view of the cap of FIG. 9.
Figure 8:
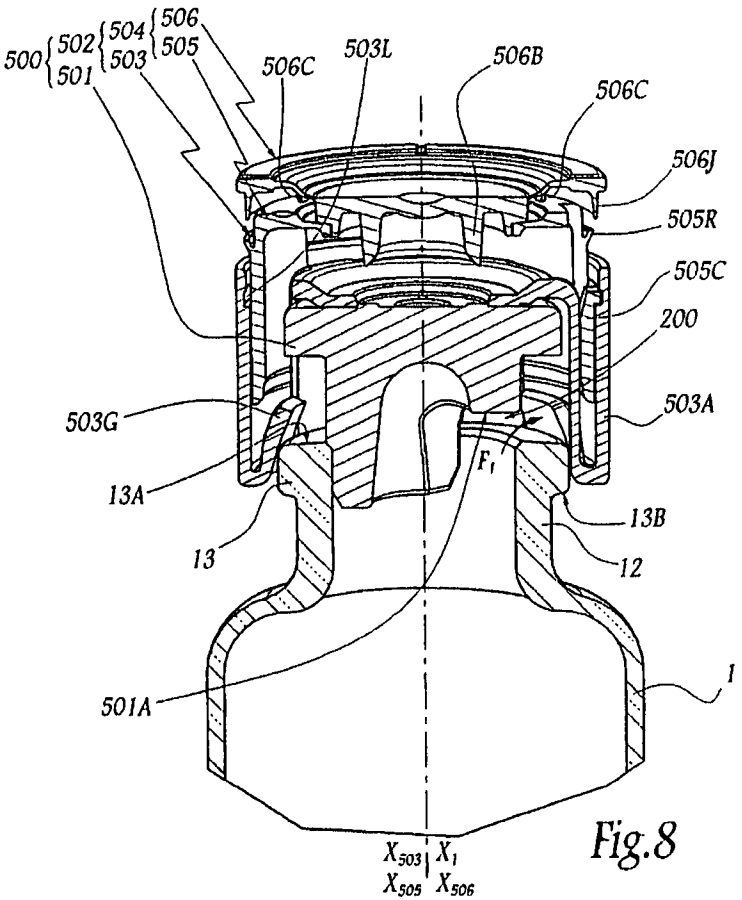
FIG. 8 is a larger-scale view of the detail VIII of FIG. 3.
Figure 11A:
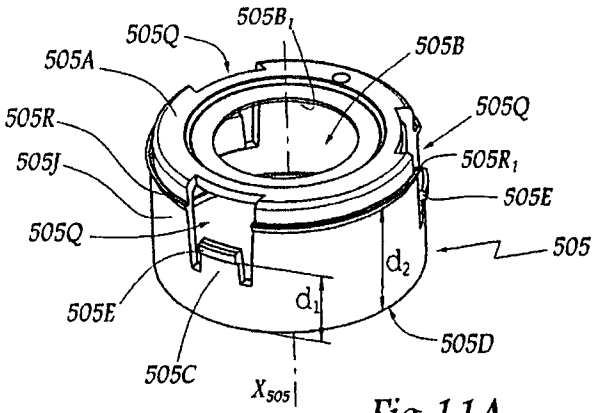
FIGS. 11A and 11B are perspective views, from two different angles, of a part of a locking member belonging to the cap of FIG. 9.
Figure 11B:
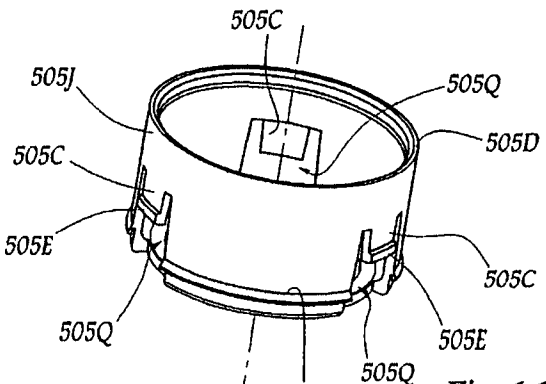

The bottle 1 equipped with the device 500 can then be introduced into a freeze-dryer 300, within a batch of bottles 1. In FIGS. 3 to 5, three bottles represent a batch which can comprise several hundred, even several thousand, bottles arranged in the freeze-dryer. Furthermore, the bottles can be positioned in the freeze-dryer on a number of stacked shelves. In this freeze-dryer, the molecules of water present in each bottle 1 are evacuated to the outside, as represented by the arrows $F_1$ in FIGS. 3 and 8, through the interstices that then remain between the cap 502 and the collar 13.

Inside the freeze-dryer 300, it is then possible, as represented in FIG. 4, to exert on the devices 500 a force $F_2$ parallel to the longitudinal axis $X_1$ of the bottles 1 and of the necks 11, an axis with which the axes $X_{503}$, $X_{505}$ and $X_{506}$ are then combined. This axial force $F_2$ is exerted by a plate 301, that moves within the freeze-dryer 300 and is controlled by a jack 302. The plate 301 at the same time exerts substantially the same force $F'_2$ on each bottle 1 of a row of bottles arranged at one and the same level, on one and the same shelf 303, in the freeze-dryer. The sum of the forces $F'_2$ is equal to the force $F_2$.

When a force $F'_2$ is exerted on the stopper 506 of a member 504, this force is transmitted by the cover 506 to the key 505 and the ribs 505E of the tongues 505$C_1$ transmit this force to the ring 503 via the interaction between these ribs 505E and the groove 503L. The tongues 505C then act as thrusters, inasmuch as they make it possible to displace or thrust the ring 503 toward the bottom 14 of the bottle 1, under the effect of the force $F'_2$, which makes it possible to achieve the configuration of FIG. 4. Because of this displacement, the locking tabs 503G are folded back toward the internal surface of the skirt 503A without there being any need to radially deform this skirt 503A. Thus, the force $F'_2$ to be applied to each device 500 to arrive at the configuration of FIGS. 4 and 13 is relatively weak.

Figure 13:
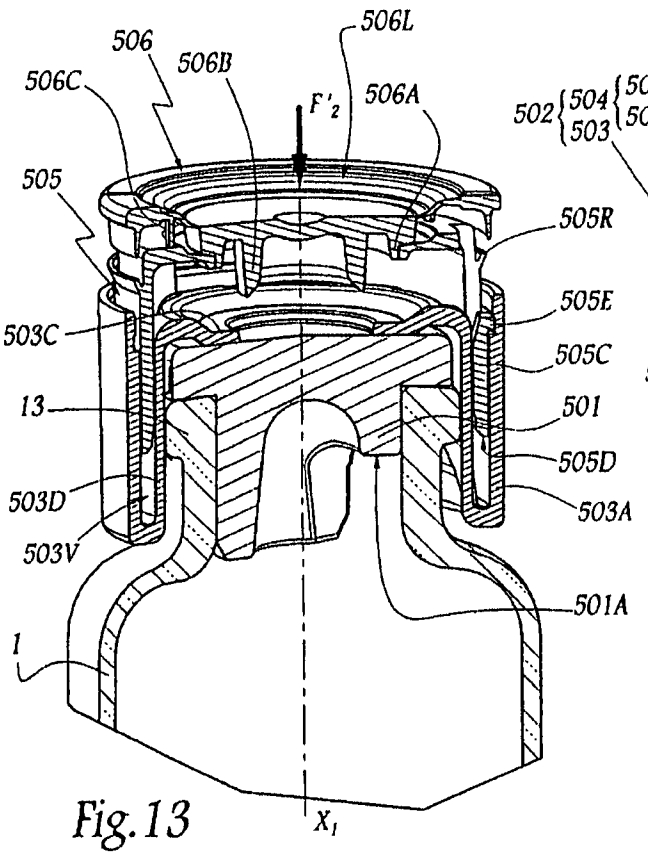
FIG. 13 is a larger-scale view of the detail XIII in FIG. 4, the pressure plate being omitted.

When the locking tabs 503G have passed the collar 13 and reached the position of FIGS. 4 and 13, the ring 503 can no longer be displaced toward the bottom 14 because the part 503C bears against the stopper 101 which is engaged in the neck 12. Maintaining the force $F'_2$ then has the effect of driving the ribs 505E out of the groove 503L and of displacing the member 504 relative to the ring 503 to the point of bringing the edge 505D into the bottom of the volume 503V, between the locking tabs 503G and the internal surface of the ring 503A. This engaging of the edge 505B between the locking tabs 503G and the skirt 503A has the effect of radially deforming these tabs centripetally, their respective free edges 503J being displaced toward the axis $X_1$. These edges then bear against the annular face 13B of the collar 13 facing toward the bottom 14, so that the bottle top 500 is firmly locked onto the neck 12, as represented in FIGS. 5 and 14.

Figure 14:
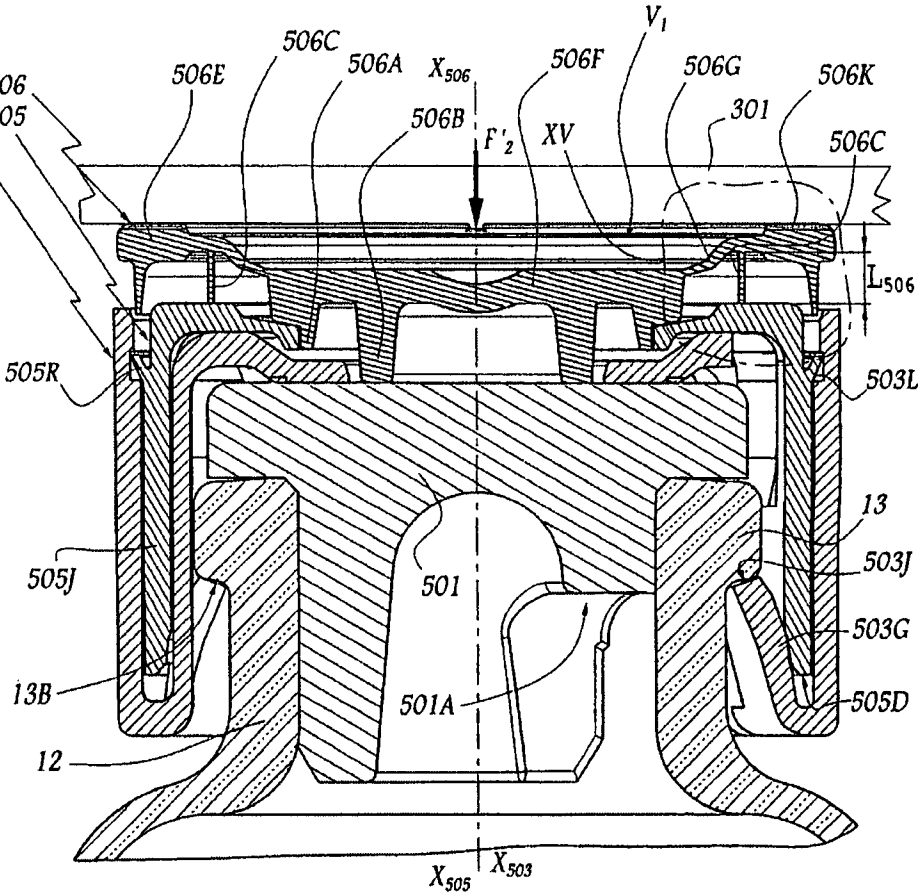
FIG. 14 is a larger-scale axial cross section corresponding to the detail XIV in FIG. 5, the pressure plate being partly represented.

In the configuration of FIGS. 5 and 14, the collar 505R engages in the groove 503L, which makes it possible to immobilize the member 504 relative to the ring 503. In other words, the difference between the distances $d_1$ and $d_2$ corresponds to the travel of the member 504 between the positions of FIGS. 4 and 5, which makes it possible to automatically grip the collar 505R with the groove 503L when the locking tabs 503G are locked in the position for holding the cap 502 on the neck 12.

Thus, the final placement of the cap 502 takes place in two steps. In the first step, the stopper 501 is put in place and the tabs 503G are folded back toward the skirt 503A to extend beyond the collar 13. In the second step, the tabs 503G are locked in position by the edge 505D.

Inasmuch as a number of bottles 1 are placed on one and the same shelf 303 inside the freeze-dryer 300, the individual force $F'_2$ applied by the plate 301 to each cover 506 can vary given the dimensional tolerances of the constituent elements of the caps 500, the tolerances in the device for guiding and driving the plate 301 and the flatness of this plate. In order to avoid having some of the caps 502 remain in an intermediate position between the FIGS. 4 and 5 at the end of the downward motion of the plate 301, a specific device for transferring the force $F'_2$ between each stopper 506 and the associated key 505 is provided.

More specifically, each stopper 506 is equipped with six tongues 506C which are made as a single piece with the rest of the stopper 506, evenly distributed about the axis $X_{506}$ and extending from a face 506D of this cover which normally faces toward the part 505A of the key 505. Each tongue 506D has an elongate form in a direction parallel to the axis $X_{506}$, with an overall parallelepipedal and constant section along its length. $L_{506}$ denotes the length of a tongue 506C taken parallel to the axis $X_{506}$ in its stress-free configuration of FIGS. 12A and 12B. Also, its width is denoted $L_{506}$ and its thickness is denoted $e_{506}$. The length $L_{506}$ is greater than or equal to six times the thickness $e_{506}$, so that each tongue 506C is flexible. It can be elastically deformed by buckling when it is subjected to a compression force exerted between its end 506$C_1$ attached to the rest of the stopper 506 and its free end 506$C_2$.

When the cap 502 of a device with which one of the bottles 1 placed on a shelf 303 is equipped reaches the configuration of FIGS. 5 and 14, it is possible, given the tolerances and variations mentioned hereinabove, for the cap of another bottle to still be in an intermediate configuration between those of FIGS. 4 and 5. To ensure that all the caps 502 of a batch of bottles 1 placed on a shelf 303 do indeed reach the configuration of FIG. 5, the force $F'_2$ is transmitted between the cover 506 and the ring 505 of each cap 502 by means of the tongues 506C. In other words, the force $F'_2$ that is axial and parallel to the axes $X_1$, $X_{503}$, $X_{505}$ and $X_{506}$, and applied by the plate 301 to a cover 506, is subdivided into a number of individual and axial forces $f'_2$ each applied by the free end face 506$C_1$ of a tongue 506C to the annular part 505A of the ring 505. A reaction force $r'_2$ in the reverse direction to each individual force $f'_2$ is exerted by the part 505A on the free end of each tongue 506C.

As long as the edge 505D of the key 505 has not reached the position where it folds back the tongues 503G toward the neck 12, the individual reaction force $r'_2$ exerted on each tongue 506C is of a relatively low intensity given the current displacement of the ring 505.

While the key 505 is being displaced inside the ring 503, between the configurations of FIGS. 4 and 5, each tongue 506C is subjected to a buckling force between its free end 506$C_1$ and its end 506$C_2$ forming the junction with the face 506B. The width $L_{506}$ and the thickness $e_{506}$ of the tongues 506C are sufficient for each tongue to undergo this force without being deformed, in particular retaining its original length $L_{506}$. The force $f'_2$ is thus effectively transmitted to the key 505 to displace it.

On the other hand, from the instant when the key 505 reaches the configuration of FIGS. 5 and 14, the downward motion of the plate 301 is continued because of an increase in the force $F_2$, which induces an increase in the forces $F'_2$ and $f'_2$.

Figure 15:
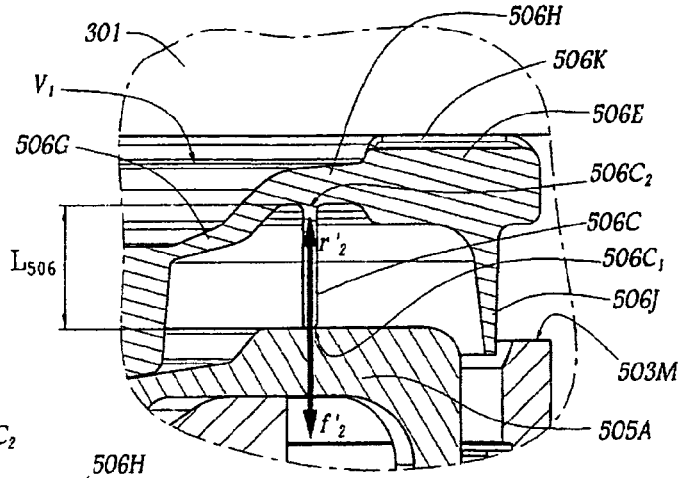
FIG. 15 is a larger-scale view of the detail XV in FIG. 14.
Figure 16:
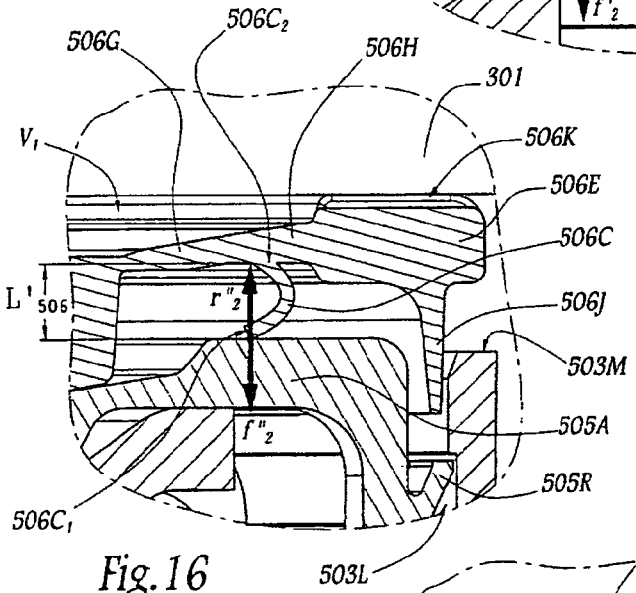
FIGS. 16 and 17 are detail views similar to FIG. 15, in subsequent steps of the closure method.

When the force $F'_2$, and consequently the individual forces $f'_2$, exceed a predetermined value which depends on the geometry of the tongues 506C, these tongues buckle to successively reach the configurations represented in FIGS. 15 and 16.

In practice, each tongue 506C can be modeled like a beam of rectangular section having a free end 506$C_1$ and an embedded end 506$C_2$. This beam can withstand a buckling force until the latter exceeds a critical value $f'_0$, the intensity of which is equal to $$\frac{\pi^2 EI}{(KL_{506})^2}$$

where E is the Young's modulus of the constituent material of the beam, I its quadratic modulus, $L_{506}$ the length of the beam and K a coefficient at the limit conditions.

In the case in point, when a critical value $f'_0$ is reached for the buckling force undergone by the different tongues 506C, each tongue 506C is deformed by buckling.

The thrust force $f''_2$ then transmitted by each tongue 506C to the key 505 is of very low intensity, substantially lower than the force $f'_2$, because the tongue is very flexible parallel to its thickness. The reaction force $r''_2$ then exerted on the end face 506$C_1$ of each tongue 506C is also of very low intensity, so that the resultant of the reaction forces of the key on the cover does not hamper the motion of the plate 301 toward the shelf 303.

The cover 506 is thus partially deformed toward the bottom 14 of the bottle 1, as represented in FIG. 16. An external skirt 506J of the cover 106 is engaged between the top edge 503M of the ring 503 and the annular part 505A of the key 505.

Figure 17:
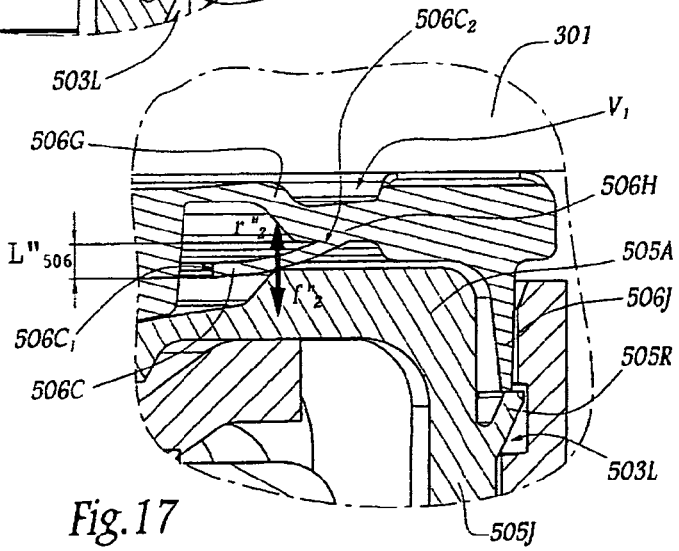

Because of its collapse through buckling each tongue 506C can then slide over the part 505A to reach the configuration of FIG. 17 in which the end faces 506$C_1$ of the different tongues 506C are no longer in contact with the ring 505.

In practice, the forces $f''_2$ and $r''_2$ are negligible relative, respectively, to the forces $f'_2$ and $r'_2$. For clarity in the drawing, the representation of the forces $f''_2$ and $r''_2$ is enlarged in FIGS. 16 and 17 compared to that of the forces $f'_2$ and $r'_2$ in FIG. 15.

$L'_{506}$ and $L''_{506}$ respectively denote the axial length of a tongue 506C in the configuration of FIGS. 16 and 17, this length being taken parallel to the axis $X_{506}$ which is then combined with the axes $X_1$, $X_{503}$ and $X_{505}$. Because of the buckling of the tongues 506C, the value of $L''_{506}$ is less than that of $L'_{506}$ which is less than that of $L_{506}$ which corresponds to the value of this length used to transmit the force $f'_2$ and to the stress-free length of the tongues.

Because of the excess travel obtained by displacement of the external radial portion 506E of the stopper 506 between the configurations of FIGS. 15 and 17, the force $F_2$ can be distributed over the caps 502 of the bottles 1 whose keys 5 have not yet reached the configuration of FIGS. 5 and 14. In other words, the tongues 506C make it possible for the covers 506 of the caps 502 that are already locked onto the necks 12 of the corresponding bottles 1 not to oppose the continued motion of the plate 301 and the locking of the other caps 502.

Thus, even if different forces may be needed to lock the different caps 502 onto the stoppers 501, notably because of the manufacturing tolerances and the plays in the driving of the plate 301, the transmission of the thrust forces $F'_2$ between the different covers 506 and the different keys 505 by means of the tongues 506C makes it possible, thanks to their buckling, to ensure that all the caps 502 are effectively locked on completion of the travel of the plate 301.

Each cover 506 comprises a relatively bulky central portion 506F from which extend the lips 506A and 506B. This portion is linked by a flexible annular portion 506G to a rigid crown 506H, from which extend the tongues 506C. The crown 506H is rigidly linked to the external radial portion 506E of the cover 506 which is edged by the external peripheral edge 506M of the cover. Thanks to its deformable nature, the portion 506G enables the portions 506E, 506H and 506J to accompany the crushing motion of the tongues 506C after they have been buckled.

To allow for a good distribution of the force $F_2$, taking into account the different positions that the bottles 1 can occupy on the shelf 303, the face 301A of the plate 301 facing toward this shelf is flat. Given the starting geometry of the stopper 506, a hollow volume $V_1$ is provided between the portion 506F and the surface 301A, this hollow volume extending radially above the portions 506F, 506G and 506H, to the internal edge of the portion 506E.

Upon the collapse of the tongues 506C and the deformation of the portion 506G, the volume $V_1$ is reduced. To prevent the cover 506 from adhering to the wall 301A by suction effect, grooves 506K are provided on the face 506L of the stopper opposite the face 506D, there being four of these grooves extending radially over the width of the portion 506E, so that they link the volume $V_1$ to the edge 506M.

Figure 12A:
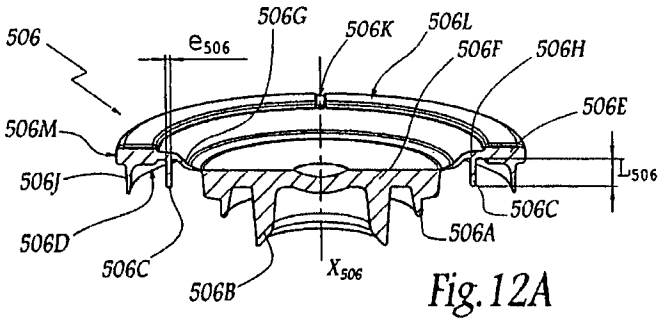
FIGS. 12A and 12B are perspective views, from two different angles, of a cover belonging to a locking member of the cap of FIG. 9, FIG. 12A including a partial cutaway.
Figure 12B:
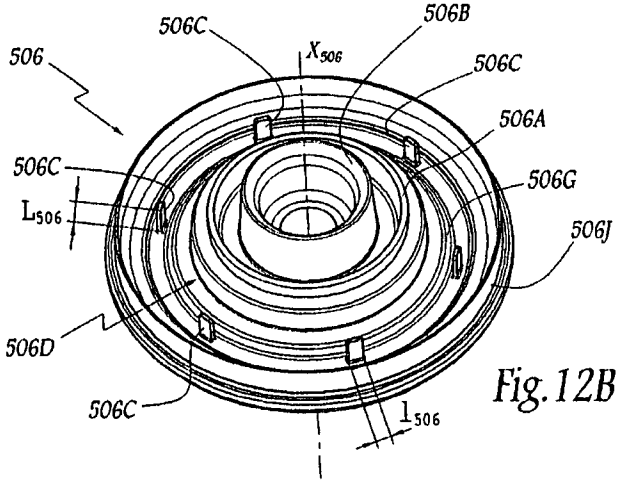
Figure 12C:
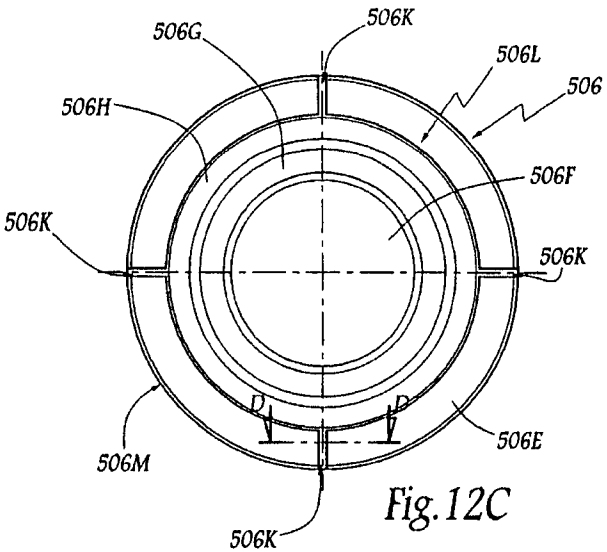
FIG. 12C is a plan view of the cover of FIGS. 12A and 12B.
Figure 12D:
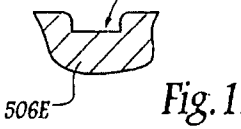
FIG. 12D is a larger-scale partial section along the line D-D in FIG. 12C.

As can be seen in FIG. 12D, each of the grooves 506K has a generally square transverse section.

Figure 21A:
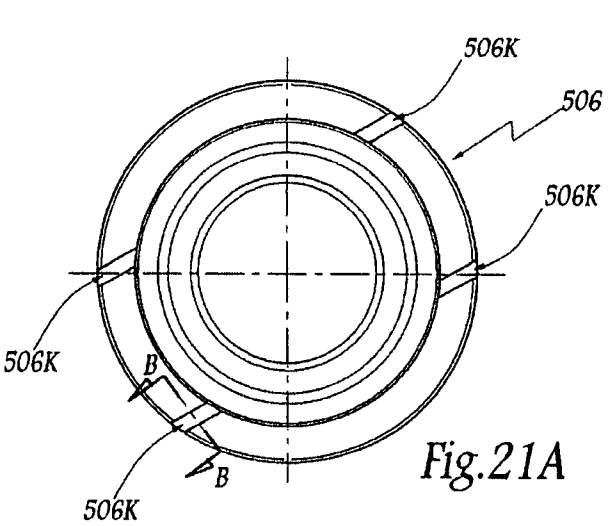
FIGS. 21A and 21B are views similar to FIGS. 12C and 12D for a stopping device in accordance with a third embodiment of the invention.
Figure 21B:
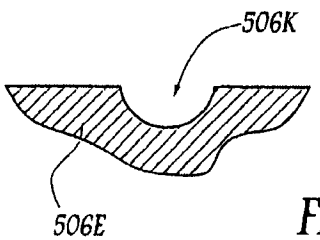
Figure 20A:
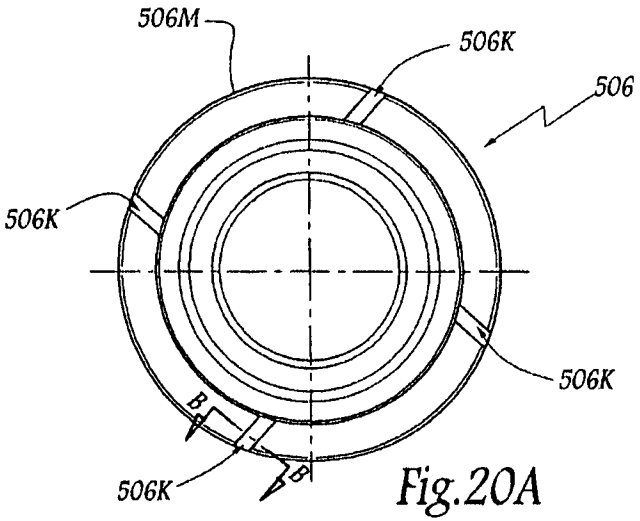
FIGS. 20A and 20B are views similar to FIGS. 12C and 12D for a stopping device in accordance with a second embodiment of the invention.
Figure 20B:
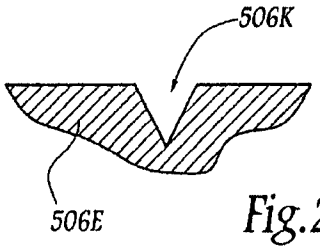

Obviously, the number and the distribution of the grooves 506K can be modified within the framework of the present invention. In the first embodiment, the grooves 506K extend in directions that are radial relative to the axis $X_{506}$. However, as represented in FIGS. 20A and 21A, other distributions of these grooves can be envisaged. Furthermore, as FIGS. 20B and 21B show, these grooves can have a V-shaped or rounded section. The different forms and distributions of grooves represented respectively in FIGS. 12C, 12D, 20A, 20B, 21A and 21B can be combined within the framework of the present invention. Furthermore, ribs can be provided, projecting on the top face 506L of the portion 506E, in place of the grooves 506K.

Figure 18:
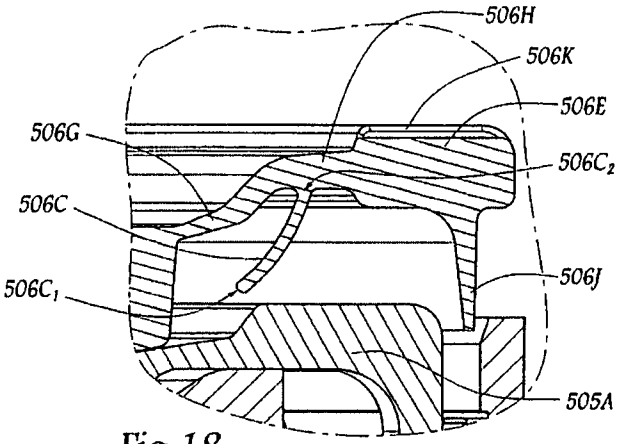
FIG. 18 is a detail view similar to FIG. 15 after the end of the application of the closure force.

On completion of the travel of the plate 301, all the caps 502 are effectively locked onto the corresponding bottles 1, the covers 506 being in the configuration of FIG. 16. The plate 301 is then raised and, under the effect of the elasticity of the portion 506G, the covers assume the configuration of FIG. 18 which is similar to that of FIGS. 14 and 15, except that the tongues 506C are no longer straight and parallel to the axis $X_{506}$. Thus, on completion of the closure of a batch of bottles 1, all the caps 502 are in the same configuration, which facilitates subsequent inspection operations on the batch of bottles 1.

Since all the stopping operations take place in a medium that is isolated from the outside, the stoppers 501 are kept sterile.

According to a variant of the invention which is % not represented, tongues similar to the tongues 506C can be provided on the top face of the annular part 505A of the key 505, in which case there is no need to provide tongues on the cover 506.

Figure 22B:
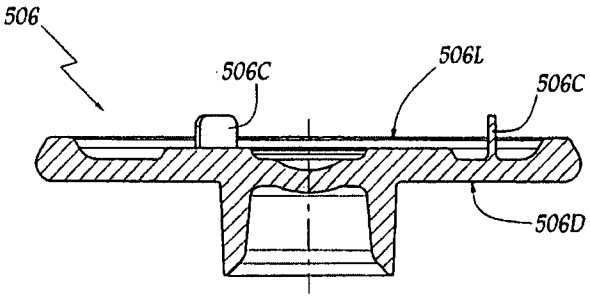
FIG. 22B is a cross section along the line B-B in FIG. 22A.
Figure 22A:
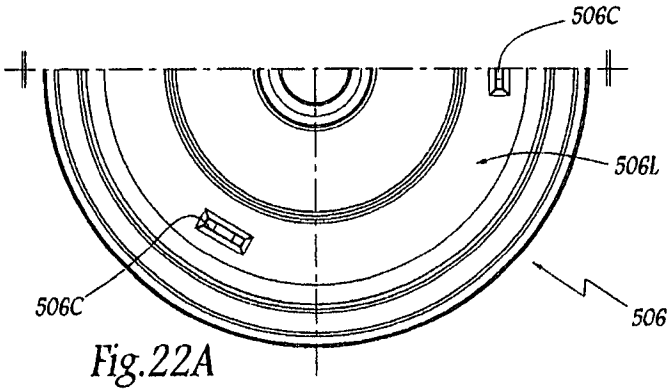
FIG. 22A is a half plan view of a cover belonging to a stopping device in accordance with a fourth embodiment of the invention.

According to another variant partially represented in FIGS. 22A and 22B, the cover 506 can be provided with three tongues 506C having the same function as those of the first embodiment, but provided on its face 506L intended to be opposite the corresponding key. These tongues 506C are intended to have the bottom surface 301A of the pressure plate 301 bear on them.

As previously, these tongues 506C are deformed by buckling, under the effect of the force exerted by the pressure plate, when the key associated with the cover 506 has reached its position in which it locks the corresponding cap onto the bottle fitted with this cap.

FIGS. 12A and 20A show that the tongues 506C have their thickness perpendicular to a radial direction relative to the central axis $X_{506}$ of the stopper 506. It is, however, possible to provide for this thickness to be parallel to such a radial direction.

Figure 7:
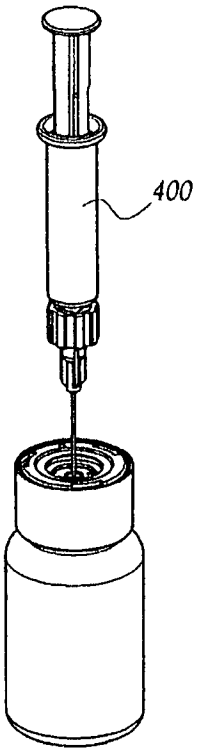
Figure 6:
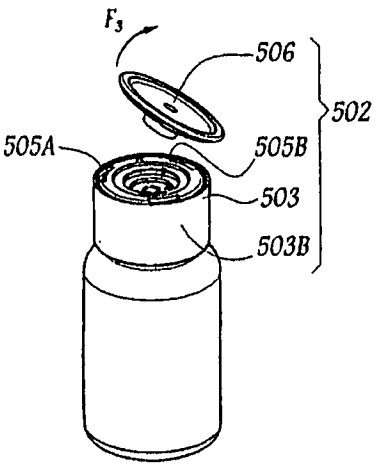

When the content of the bottle 1 is to be used, the cover 506 is removed, as represented by the arrow $F_3$ in FIG. 6, which makes it possible to access a central portion of the stopper 501. It is then possible to inject into the bottle 1 a liquid to reconstitute its content, by means of a syringe 400, as represented in FIG. 7, then to pump the reconstituted product using the same syringe, the needle of which passes through the stopper 501 according to an approach known to hospital personnel.

The materials used for the parts 503, 505 and 506, which are single-piece, are designed to retain their mechanical property over a range of temperatures between −80 and +120° C. It may be, for example, polyoxymethylene (POM) or polybutylene terephthalate (PBT).

The invention has been described in the case of use for a bottle whose content is freeze-dried. It can also be applied to the case where the content of the bottle is not freeze-dried. In this case, the stopper 501 can be put in place on the bottle 1 in a step immediately after it has been filled then the cap 502 can be put in place immediately after, within a sterile chamber that is not represented, and by an axial force, which also makes it possible to achieve a sealed configuration similar to that of FIGS. 5 and 14.

The invention claimed is:

1. A device for stopping a container provided with a neck, the device comprising:

an elastomeric stopper; and a cap made of polymeric material, able to cover both the neck and the stopper in position in the neck, the cap comprising:

a ring, able to surround the stopper and the neck in the fitted configuration and provided with locking means for locking it onto the neck, and an operating member able to be fitted on the ring and provided with first means for transmitting a first thrust force to the ring and second means for activating the locking means of the ring, wherein the operating member is equipped with at least one deformable force transmission element which transmits a second thrust force, parallel to a central axis of the ring, between two parts of said operating member or between an external appliance and the operating member, and wherein the force transmission element is deformable between a first configuration in which a length of the force transmission element parallel to the central axis has a first value and a second configuration in which the length of the force transmission element parallel to the central axis has a second value less than the first value.

2. The device as claimed in claim 1, wherein the force transmission element is able to be deformed by buckling to change from its first to its second configuration.

3. The device as claimed in claim 1, wherein the thrust force transmission element or elements is or are positioned on a face of the cap opposite to the stopper.

4. The device as claimed in claim 1, wherein the second means comprise an annular edge of the operating member, said edge being able to be engaged between an external skirt of the ring and at least one tab of the locking means and extending radially toward a central axis of the ring from its skirt.

5. The device as claimed in claim 1, wherein the force transmission element comprises a straight tongue extending in a direct ion parallel to that of the second thrust force and one end of which is joined to a part of the operating member, whereas its other end is free and forms a transmission surface for the second thrust force.

6. The device as claimed in claim 5, wherein the tongue has an overall parallelepipedal and constant section along this tongue, the tongue having, in its first configuration, a length with a value greater than or equal to six times its thickness.

7. A container equipped with a stopping device as claimed in claim 1.

8. A batch of containers in accordance with claim 7, wherein, after the force transmission elements have changed to their second configuration and the first thrust force has been eliminated, the caps are able, through elasticity, to assume one and the same configuration.

9. A method for closing a batch of containers as claimed in claim 7, wherein it comprises steps consisting in:

a) exerting, on the devices of a plurality of containers and by means of a pressure plate, a thrust force directed toward the containers and b) maintaining the thrust force until the force transmission elements of the various devices all change from their first to their second configuration.

10. The method as claimed in claim 9, wherein, in the step b), the value of the thrust force is gradually increased.

11. The device as claimed in claim 1, wherein the operating member comprises an annular key which bears the first and second means and a cover fitted on the key and wherein the force transmission element or elements is or are positioned between the cover and the key and is or are able to transmit the second thrust force from the cover to the key.

12. The device as claimed in claim 11, wherein the force transmission element or elements is or are positioned on a face of the key facing toward the cover and wherein this force transmission element or these elements is or are able to receive the cover bearing on it or them.

13. The device as claimed in claim 11, wherein the force transmission element or elements is or are positioned on a face of the cover facing toward the key and able to bear against the key to transmit the second thrust force to it, and wherein the cover is flexible, so as to accompany the deformation of the force transmission element or elements when it or they change from its or their first configuration to its or their second configuration.

14. The device as claimed in claim 13, wherein the cover is provided with a deformable annular zone situated radially, relative to a central axis of the cover, inside a circumference at the level of which are arranged the force transmission elements.

15. The device as claimed in claim 13, wherein the cover is provided, on its face opposite to that bearing the force transmission element or elements, with at least one relief positioned so that a portion of the cover surrounding the deformable zone has a surface that is not totally flat.

16. The device as claimed in claim 15, wherein the relief is a groove linking the vicinity of the deformable annular zone of the cover to the external peripheral edge of this cover.

* * * * *